United States Patent [19]

Tamura et al.

[11] 4,058,439

[45] Nov. 15, 1977

[54] NICKEL ELECTROPLATING BATH FOR SATIN FINISH AND METHOD

[75] Inventors: Toshio Tamura, Tokyo; Shigeo Oouchi, Yokahama; Kenji Oosawa, Hino; Shimetomo Fueki, both of Tokyo, all of Japan

[73] Assignee: Sony Corporation, Tokyo, Japan

[21] Appl. No.: 705,797

[22] Filed: July 16, 1976

[30] Foreign Application Priority Data

July 17, 1975 Japan ..... 50-87586

[51] Int. Cl.[2] ..... C25D 3/12

[52] U.S. Cl. ..... 204/49

[58] Field of Search ..... 204/49, 16

[56] References Cited

U.S. PATENT DOCUMENTS

| | | | |
|---|---|---|---|
| 3,356,467 | 12/1967 | Brown et al. | 204/49 X |
| 3,471,271 | 10/1969 | Brown et al. | 204/49 X |
| 3,839,166 | 10/1974 | Michael | 204/49 |

*Primary Examiner*—G. L. Kaplan

*Attorney, Agent, or Firm*—Lewis H. Eslinger; Alvin Sinderbrand

[57] ABSTRACT

A nickel electroplating emulsion bath for obtaining a satin-finish which comprises an aqueous acidic continuous phase nickel salt solution, an alcohol soluble polyamide resin dispersed therein and a polishing agent and the method for using the bath. The polyamide resin is a member selected from the group consisting of a copolymer of dimer acid and an aliphatic amine, a copolymerized nylon and a modified nylon. The electroplating bath preferably also contains a cationic surface active agent selected from the group consisting of an aliphatic and/or aromatic quaternary ammonium salt and an aliphatic and/or aromatic fluorosulfonylamine quaternary ammonium salt. The use of the electroplating bath provides a means for obtaining a uniform satin-finish nickel plate surface on the material plated.

19 Claims, 2 Drawing Figures

NICKEL ELECTROPLATING BATH FOR SATIN FINISH AND METHOD

SUMMARY OF THE INVENTION

The present invention relates to an electroplating bath and particularly to a nickel electroplating bath for obtaining a satin-finish nickel plate surface and to a method of using the bath. More particularly, the present invention relates to a nickel electroplating emulsion bath for obtaining a satin-finish nickel plated surface which bath comprises an aqueous acidic continuous phase nickel salt solution, an alcohol soluble polyamide resin dispersed therein and a polishing agent. The electroplating bath also preferably contains a cationic organic quaternary ammonium surfactant to stabilize the bath.

The so-called satin-finish referred to herein is intended to mean a finely rough surface which has the effect of lessening the glossiness or light reflective capability and brightness or light dazzling effect of the nickel plated surface. The satin-finish nickel plated surfaces of the present invention are used on surfaces of apparatus such as cameras, typewriters and computers to provide a decorative as well as a protective finish.

BACKGROUND OF THE INVENTION

The use of nickel electroplating baths to obtain a satin finish are generally known. An electroplating bath containing an aqueous nickel solution and fine insoluble inorganic particles, which are suspended in the solution by air agitation, has been used to simultaneously deposit nickel and the fine particles on the material plated. However, in this method some of the suspended particles are inadvertently and separately deposited on the surface of the plated materials and must be removed. This may require an additional manual step with the inherent disadvantage of possibly leaving fingerprints on the plated materials.

Another nickel electroplating bath for obtaining a satin finish is described in U.S. Pat. Nos. 3,839,165 and 3,839,166. The electroplating baths described in the patents include a nonionic, alkylene oxide surfactant which has the following formula $R_1[X(R_2O)_m(R_3O)_n]_pR_4$ wherein X is selected from the group consisting of oxygen, sulfur or —NH—, $R_1$ and $R_4$ are selected from the group consisting of hydrogen and an organic radical, $R_2$ and $R_3$ are selected from the group consisting of ethylene and propylene and *m, n* and *p* are whole numbers. The nonionic surface active agents form turbid solutions at 40° to 75° C. Patentees in carrying out the described electroplating method utilize a "cloud point phenomenon" to obtain a satin finish. The nonionic surface active agents though readily soluble at the lower temperatures are difficulty soluble at higher temperatures, at which they rapidly flocculate. Further, the electroplating characteristics of the bath change during periods of use within, for example, less than about 2 hours such that the appearance of the nickel plated surfaces change during the plating operation and are not uniform. A particular problem with using the baths described in the patents is that it is very difficult to obtain a satin finish of uniform grain size. In order to regenerate the baths they should be first cooled and then reheated. Further, the apparatus used to regenerate the baths is relatively expensive.

In still another method for obtaining a satin finish, the surface to be plated is first finely roughed by sandblasting which is costly and substantially adds to the expense of the plating operation.

An object of the present invention is to provide an improved electroplating bath and method for obtaining a uniform satin finish of the metal plate surface on the material plated.

Another object is to provide an improved nickel electroplating emulsion bath and method for obtaining a uniform satin-finish nickel plate surface on the material plated.

Another object is to provide a stable nickel electroplating emulsion bath which during use provides a uniform satin-finish nickel plate surface on the material plated.

Another object of the invention is to provide a stable nickel electroplating emulsion bath which can be used, be allowed to stand for extended periods of time and used again to provide a uniform satin-finish nickel plate surface on the material plated.

A further object of the invention is to provide a stable nickel electroplating emulsion bath which can be regenerated after use easily and inexpensively without the use of special regeneration apparatus.

A still further object is to provide a stable nickel electroplating emulsion bath which efficiently utilizes electrical current in operation of the bath to plate nickel on the surface to be plated.

BRIEF DESCRIPTION OF THE INVENTION

In accordance with a preferred embodiment of the present invention a nickel electroplating emulsion bath for obtaining a uniform satin-finish nickel plate surface on the material plated is prepared. The bath consists essentially of an aqueous acidic continuous phase nickel salt solution, an alcohol soluble polyamide resin dispersed therein and a polishing agent. The satin-finish nickel surface can be further plated with other metals such as tin - cobalt alloy or copper to make them more ornamental and/or make the surface more protective.

The polyamide resin used herein has an amide linkage $$\left(\text{NH}-\underset{\underset{\text{O}}{\|}}{\text{C}}\right)$$

in the main chain of the molecule and is a member selected from the group consisting of a coplymer of dimer acid and an aliphatic amine, a copolymerized nylon and a modified nylon.

The alcohol is a lower alkyl alcohol in which the polyamide resin is soluble. The polyamide resin is first dissolved in the alcohol which helps to emulsify and/or disperse the resin in the aqueous phase nickel solution.

The polishing agents that can be used are aromatic sulfonic acid salts, aromatic sulfonimide salts and aromatic sulfonamide salts.

In one embodiment of the invention a cationic aliphatic quaternary ammonium salt surfactant is used to stabilize the bath and in an other embodiment a fluorosulfonylamine salt surfactant is used to stabilize the bath. The use of these surfactants improves the stability of the bath during use and during nonuse when left standing such that the baths can be used for longer periods of time while still obtaining a uniform satin finish nickel plate surface and/or can be left standing for relatively long periods of time and reused and still obtain a uniform satin finish nickel plate surface on the materials plated.

Various nickel aqueous salt baths can be used such as a Watts bath which consists of nickel sulfate, nickel chloride, boric acid, or a nickel sulfamate bath which consists of nickel sulfamate, nickel chloride, boric acid. The electroplating emulsion bath of the present invention can be used to plate various different surfaces such as resins, e.g. ABS resins which are electroless plated with copper or metal surfaces such as brass, copper, nickel and any surface which has electro-conductivity.

The polyamide resins used in the present invention have a very low flocculating rate and as compared to the prior art baths form relatively stable emulsions even without the addition of surface active agents. The satin finish surface obtained in accordance with the present invention is substantially uniform over relatively long periods of use, even when the use of the baths is interrupted and the bath is allowed to stand unused for relatively long periods of time. For example the bath can be used to obtain uniform satin finishes when used more than a week after preparation in which case the satin finish obtained compares favorably with the satin finishes obtained when using the bath soon after its initial preparation. The baths can be maintained and used in a conventional manner. The normal used special regeneration processes of the prior art are not required to regenerate and replenish the baths. It is only necessary from time to time to filter the bath to remove precipitates and/or coagulants and to replenish the constituents of the bath as used. The electroplating baths are accordingly inexpensive to operate and a satin finished surfaces can be obtained at very low costs.

The use of the organic quaternary ammonium salt surface active agents in accordance with the present invention substantially improves the stability of the baths both during use and on standing. The aliphatic quaternary ammonium salt surfactants can be added to the baths as the sole surfactants and the fluorosulfonylamine salt surfactants can be added to the baths as the sole surfactants. The fluorosulfonylamine salt surfactants were found to substantially and greatly improve the stability of the baths when used either alone or in a mixture with the aliphatic quaternary ammonium salt surfactants.

DESCRIPTION OF THE INGREDIENTS

1. Nickel Salts

Figure 1:
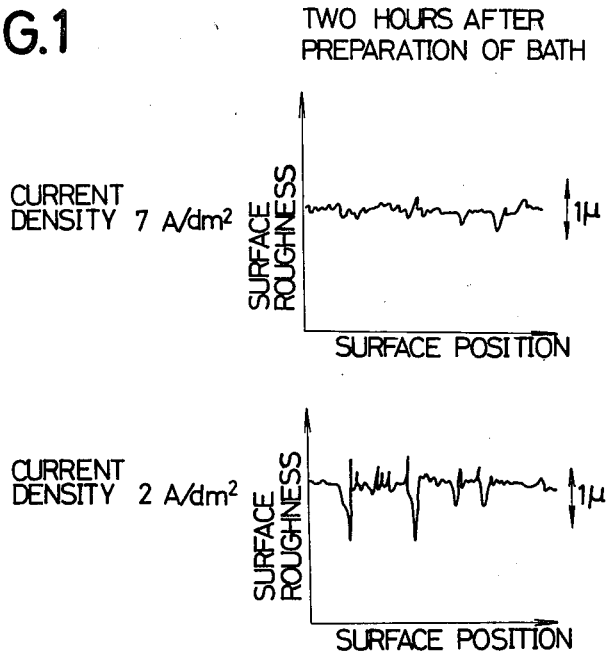
FIG. 1 is a graph illustrating the surface roughness of a nickel plated material obtained without the use of a surface active agent.

The electroplating bath of the present invention preferably comprises one or more water soluble nickel salts.

The nickel salts used in the Watt's bath, for example, can be nickel sulfate ($NiSO_4 \cdot 7H_2O$), nickel chloride ($NiCl_2 \cdot 6H_2O$).

The nickel salts used in the nickel sulfamate bath can be nickel sulfamate ($Ni(SO_3NH_2)_2 \cdot 4H_2O$), and nickel chloride ($NiCl_2 \cdot 6H_2O$).

2. Acids

Boric acid ($H_3BO_3$) is added to the bath to stabilize and minimize the fractuation of the acidity. The added amount of boric acid is less than 80 g/l, more preferably from 20 to 50 g/l.

3. Polyamide Resins a. Copolymers of Dimer Acid and Aliphatic Amines. The polyamide copolymer resins are commercially available under the tradename Versamid from DAI-ICHI GENERAL, LTD. whose address is 5 chrome, Koraibashi, Higashi-ku, Osaka-shi, Osaka, Japan and Tohmide from Fuji Chemical Industry Company, Ltd. whose address is 21 Izumicho, Itabashi-ku, Tokyo, Japan.

The polyamide copolymer resins are produced by the copolymerization of an unsaturated dimer acid and an aliphatic polyamine.

The polyamide copolymer resin has the formula $$H_2N\text{-}\!\left[(CH_2\text{-}CH_2\text{-}NH)_{n_1}\text{-}OC\text{-}R\text{-}CONH(CH_2\text{-}CH_2\text{-}NH)_{n_2}\right]_{n'}\text{-}H \qquad \text{I}$$

wherein R represents the residual radical of the dimer unsaturated acid containing 14 to 46 carbon atoms, $n_1$, $n_2 = 1$ to 5 (one of the $n_1$ and $n_2$, however, may be equal to 0.) and $n' = 1$ to 13.

One example of the dimer acid is believed to have the formula

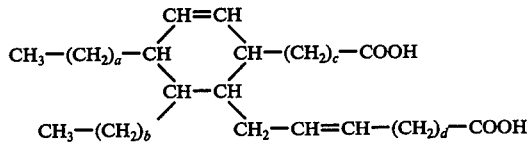

II wherein each of $a$, $b$, $c$ and $d$ is 0 to 18, and the sum of $a$, $b$, $c$ and $d$ is 3 to 35.

The dimer acid is obtained by the thermal polymerization of an unsaturated fatty acid such as a refined vegetable fatty acid or tall oil fatty acid. A particularly useful dimer acid is dilinoleic acid in which $a = 5$, $b = 4$, $c = 7$ and $d = 7$.

The aliphatic polyamine has the formula $$H_2N\text{-}\left[CH_2\text{-}CH_2\text{-}NH\right]_n\text{-}H \qquad \text{III}$$

wherein $n$ is 1 to 5.

The particularly useful aliphatic polyamines are alkylene polyamines such as ethylene diamine ($n = 1$), diethylene triamine ($n = 2$) and triethylene tetramine ($n = 3$). The copolymers of dimer acid and aliphatic polyamines used in the present invention have molecular weights in the range of 600 to 7,000. When using the copolymers of dimer acid and aliphatic polyamines having molecular weights of less than about 600, though an emulsion is obtained, a satisfactory uniform satin finish is difficult to obtain. When using copolymers having molecular weights above 7,000, though a satisfactory uniform satin finish can be obtained, the copolymer flocculating rate is too high for satisfactory use in the bath.

The below-described Versamid and Tohmide copolymer resins are illustrative of the resins that can be used in the present invention.

| | VERSAMID NO. | | | |
|---|---|---|---|---|
| | 100 | 115 | 125 | 140 |
| Constituents | Dilinoleic acid and ethylene diamine | | | |
| Amine No. | 85-95 | 230-246 | 330-360 | 370-400 |
| Viscosity | 7-12poise (150° C) | 31-38poise (75° C) | 6-9poise (75° C) | 2-5poise (75° C) |
| Spec. Gravity | 0.97 | 0.97 | 0.97 | 0.97 |
| Average Mol. Wt. | 3000 | 2000 | 800 to 1000 | 800 to 1000 |

| | TOHMIDE NO. | | |
|---|---|---|---|
| | 210 | 215 | 235S |
| Constituents | Polymerized tall oil fatty acids and diethylene triamine | Polymerized tall oil fatty acids and tri-ethylene tetra amine | Polymerized tall oil fatty acids and tetra ethylene pentamine |
| Amine No. | 100 ± 5 | 220 ± 5 | 340 ± 20 |
| Viscosity (Brookfield Visc.) | $10 \times 10^4$cps (40° C) | $7 \times 10^4$ to $5 \times 10^4$cps (40° C) | $4.5 \times 10^3$-$9 \times 10^3$cps (25° C) |
| Acid. No. | less than 4 | less than 3 | less than 3 |
| Spec. Gravity | 0.98 | 0.98 | 0.98 |
| Average Mol.Wt. | 4500 | 2500 | 1000 |

The dimer acids usually contain small amount of monomer and trimer of unsaturated fatty acid. 100 weight percent total fatty acid comprises from about 70 to 80 weight percent ofdimers, from about 15 to 30 weight percent of trimers, and from about 1 to 5 weight percent monomers. The commercially available Versamide and Tohmide polyamide copolymer resins usually contain a small amount of reaction products of monomer acids and trimer acids with polyamine, the presence of which do not adversely affect the electroplating bath.

b. Copolymerized Nylon

Polyamide copolymerized nylon resin used in the present invention is a copolymer of two or more than two kinds of homo-nylons. The copolymers can for example be made from at least two of 6-nylon, 6,6-nylon, 7-nylon, 9-nylon, 11-nylon and 12-nylon. The copolymers all exhibit in irregularity in molecular structure and are hard to crystallize. The polyamide copolymerized nylon resins used in the present invention have molecular weights in the range of 5,000 to 100,000 and preferably 8,000 to 50,000. Particularly useful copolymerized nylon resins that can be used are copolymer nylon No. 5053 (Tradename) which is commercially available from the Ube Industries, Limited whose address is 3-7-2, Kasumigaseki, Chiyoda-ku, Tokyo, Japan and Saitel No. 63 (Tradename) which is commercially available from Du Pont de Nemours & Co.

The copolymerized nylon is a copolymer of at least two homo nylons selected from the group of homonylons defined by a number n from 5 to 11 in the following formula

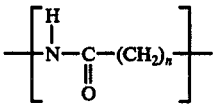

IVa and defined by a number $n_1$ from 2 to 12 and $n_2$ from 4 to 12 in the following formula

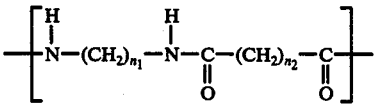

IVb

The detail description of copolymerized nylons that can be used in accordance with the present invention are given below.

| | COPOLYMERIZED NYLON NO. | |
|---|---|---|
| | Saitel 63 | 5053 |
| Constituents | | Copolymer 6-nylon and 6,6-nylon |
| Melting Point | 157° C (by ASTM D789) | 127° C |
| Spec. Gravity | 1.08 (by ASTM D792) | 1.13 (by JIS K6810, at 20° C) |
| Mean Mol. Wt. | 48,000 | 10,000 |

c. Modified Nylon

The polyamide modified nylon resins are prepared by modifying a nylon to add at a nitrogen atom an alkyl polyoxymethylene or alkyloxy methylene into the nylon molecule. The modified nylon resin contains following structural unit in the main chain of the molecule.

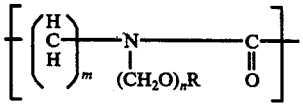

V wherein R represents methyl or ethyl, $n = 1$ to 5, and $m = 5$ to 11.

The modified nylon is produced by reactin for example 6-nylon of the formula

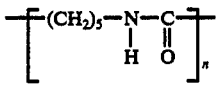

with HCHO (formaldehyde) and $CH_3OH$ or $C_2H_5OH$ (methyl or ethyl alcohol) to partially substitute the formaldehyde for the hydrogen of the amide nylon group and to form the corresponding methyl or ethyl ester thereof. The $(CH_2O)_n$-R is substituted for hydrogen of the —NH— in the nylon to disturb the regularity of the molecule thus making the modified nylon resin hard to crystallize.

The polyamide modified nylon resins have molecular weights in the range of 5,000 to 100,000 and preferably 10,000 to 50,000. A suitable modified nylon resin is for example Type 8 nylon which is commercially available from UNITIKA, LTD. whose address is 3-3, Yaesu, Chuo-ku, Tokyo, Japan.

The below-described modified nylons are illustrative of the polyamide resins that can be used in the present invention.

| | MODIFIED NYLON NO. Type 8 |
|---|---|
| Reactants | Alcohol-soluble N-methoxy modified nylon-31% substitution |
| Softening Temp. | 145–160° C |
| Viscosity | 12.5cps(5% solution of methyl alcohol, at 20° C |
| Spec. Gravity | 1.1 |
| Average or Mean Mol. Wt. | 48,000 |

The polyamide resins can be used alone, mixtures of the individual polyamide resins can be used, or two or more of the resins can be used in the bath. The polyamide resins are all alcohol soluble and prior to the addition of the resins to the bath are dissolved in a low molecular weight alcohol.

4. Alcohols

The alcohols used in accordance with the present invention to dissolve the polyamide resins have 1 to 3 carbon atoms. Suitable alcohols are methanol, ethanol, normal propyl alcohol and isopropyl alcohol. The dissolving of the polyamide resin in the alcohol is found to make the resins more readily emulsifiable and/or dispersible in the electroplating bath and assists in the formation of a stable emulsion.

5. Polishing Agent

Several different polishing agents can be used in the electroplating bath. Suitable polishing agents are alkali metal aromatic sulfonic acid salts such as sodium naphthalene mono, di or tri sulfonate, an aromatic sulfonamide such as paratoluensulfonamide, an aromatic sulfonimide, alkali metal salt of aromatic sulfonamide such as sodium paratoluensulfonamide, alkali metal salt of aromatic sulfonimide such as sodium salt of saccharin.

The polishing agent makes the electroplated nickel surface more glossy and prevents the material being plated from being stressed during the electroplating operation.

The polishing agents can be used alone or in combination one with the other in the electroplating bath.

6. Organic Quaternary Ammonium Salt Surfactants a. Aliphatic And/Or Aromatic Quaternary Ammonium Halide Salt

In one embodiment of the present invention a cationic aliphatic and/or aromatic quaternary ammonium halide surfactant is added to the electroplating bath to improve the stability of the bath. The amount of surfactant added depends on the proposed use of the bath and generally within the limits described in the instant application the more of the surfactant that is added the more stable is the bath. The electroplating bath of the present invention, as compared to the prior art baths, are relatively stable. The addition of even small amounts of the aliphatic and/or aromatic surfactants were found to materially improve the stability of the emulsion bath. Cationic surface active agents such as tetraalkyl quaternary ammonium halide wherein the alkyl groups contain 11 to 21 hydrocarbons, the alkyl aromatic quaternary ammonium halides wherein the alkyl group can contain 11 to 21 carbon atoms and the aromatic group is a member selected from benzene, toluene, and naphthalene. The halide group can be a member selected from chlorine, bromine and iodine. Suitable cationic surface active agents are alkyltrimethyl quaternary ammonium chloride wherein the alkyl group contains 8 to 18 carbon atoms, and dialkylbenzylammonium chloride wherein the alkyl group contains 8 to 18 carbon atoms.

b. Fluorosulfonylamine Salt Surfactants

In accordance with another embodiment of the present invention and aliphatic fluorosulfonylamine quaternary ammonium alkyl and/or aromatic ammonium halide salt surfactant is added to the electroplating bath to improve the stability of the bath. The fluorosulfonylamine surfactant as with the previously mentioned surfactant is added to the bath to stabilize the electroplating bath. The addition of even small amounts of fluorosulfonylamine surfactant substantially improves the stability of the bath such that the bath can be used for prolonged periods of time while still obtaining uniform satin finish nickel plate surfaces, maintains the bath in a stable condition during relatively long periods of nonuse which allows the bath after standing to be reused and to again obtain uniform satin finish nickel plate surfaces with the bath.

The fluorosulfonylamine salt surfactant used in accordance with this embodiment of the invention has the formula $$C_nF_{2n+1}SO_2NH(CH_2)_3N^+(CH_3)_2RX^- \qquad \text{VI}$$

wherein $n = 6$ to 12, R is an alkyl group containing 1 to 20 carbon atoms, preferably 1 to 12 carbon atoms, an alkenyl group containing 1 to 20 carbon atoms, preferably 1 to 12 carbon atoms and having between 2 and 3 double bonds, or an aromatic group having 1 to 3 benzene rings, preferably 1 to 2 benzene rings, e.g. benzene or naphthalene, X is a halogen atom, preferably chlorine, bromine or iodine or the $HSO_4^-$ group.

These surfactants are commercially available from the DAINIPPON INK & CHEMICALS, INC. whose address is 3-7-20, Nihonobashidori, Chuo-ku, Tokyo, Japan a specific fluorosulfonylamine salt surfactant is sold under the name Megafac F-150 (TM) and has the following formula $$C_8F_{17}SO_2NH(CH_2)_3N^+(CH_3)_2CH_3I \quad \text{VII}$$

Other commercially available fluorosulfonylamine salt surfactants are $$C_8F_{17}SO_2NH(CH_2)_3N^+(CH_3)_2CH_2C_6H_5Cl^- \quad \text{VIII}$$

$$C_8F_{17}SO_2NH(CH_2)_3N^+(CH_3)_2C_{12}H_{25}Br^- \quad \text{IX}$$

It is preferable that the fluorosulfonylamine surfactant be cationic, since the electroplating bath is acidic, the polyamide resin is cationic and the nickel is plated on the material at the negative electrode. If the fluorosurfactant is not cationic the emulsion bath is difficult to stabilize.

The use of the fluorosulfonylamine salt surfactant allows the formation of stable emulsion electroplating baths at the lower concentration ranges of the polyamide resins, thus for example allowing the production, if desired of a glossier satin finish than could be obtained when using the higher concentration ranges of the polyamide resins. The use of the fluorosulfonylamine surfactants also allows the production of a grain size of the nickel plated film and the glossiness of the satin finish which is different from that obtained when not using the fluorosulfonylamine surfactant.

Electroplating Bath Composition

In the preparation of the electroplating bath a salt of the metal to be electroplated is added and dissolved to form an aqueous solution of the salt. A sufficient amount of the metal salt is added to provide the desired amount of metal ions in the solution. In the preferred embodiment of the present invention water soluble nickel salts, e.g. $NiSO_4 \cdot 7H_2O$, $NiCl_2 \cdot 6H_2O$ and/or nickel sulfamate are added in an amount sufficient to provide in the solution about 25 to 170 and preferably 30 to 150 grams of nickel per liter. The nickel salts are readily soluble in water and a clear solution is obtained. A sufficient amount of a mineral acid, for example $H_3BO_3$ or is added to stabilize and minimize the fractuation of the pH of the solution to a value of 1.4 to 6.0 and preferably 3.8 to 5.6. Depending on the particular metal salts used and the other constituents of the electroplating plate and on the acid used about 10 to 100 g/l and preferably about 30 to 60 g/l of acid are added to the bath. Care must be exercised in adjusting the pH of the bath within the prescribed limits. When the pH of the bath is too low or too high, pits may form on the plated surface. Also, when the pH is too low the cathode current efficiency deteriorates.

Prior to the addition of the polyamide resin to the electroplating bath, the resin is first dissolved in a lower alkyl alcohol, e.g. methyl, ethyl, or propyl alcohol. The polyamide resins are generally readily soluble in the alcohol and only a sufficient amount of alcohol is added to the resin to dissolve the resin. The weight ratio of polyamide resin to alcohol will vary to some extent depending on the resin used and on the alcohol used. Generally the weight ratio of polyamide resin to alcohol can be 0.02% to 10%, preferably 0.3% to 3% and more preferably 1% to 2%.

The amount of the polyamide resin added to the electroplating bath depends on which of the polyamide resins are used.

Th copolymer of the dimer acid and aliphatic polyamine is added in an amount of 1 ppm to 1000 ppm, preferably 3 to 200 ppm.

Th copolymerized nylon and modified nylon resins are added in amounts of 1 to 10,000 ppm, preferably 500 to 3,000 ppm.

If less than 1 ppm of the polyamide resins is used the satin finish of the electroplated nickel is unsatisfactory. If more than 1,000 ppm of the polyamide copolymer of the dimer acid and aliphatic polyamine resin is used, or more than 10,000 ppm of the polyamide copolymerized nylon resin or the polyamide modified nylon resin is used the flocculating rates of the electroplating baths are undesireably high such that the baths are unstable and it is difficult to obtain a uniform satin finish of an electroplated nickel from the baths.

The polishing agent for example, the aromatic sulfonic acid salt, aromatic sulfonimide salt and aromatic sulfonamide salt is added to the electroplating bath in an amount of 0.1 g/l to 30 g/l and preferably 0.5 g/l to 10 g/l. If less than about 0.1 g/l of surfactant is used, a satisfactory satin finish is not obtained and if more than about 30 g/l is used in the bath the nickel plated surface is too glossy and the stability of the electroplating bath is adversely affected. When the amount of polishing agent used is in the lower end of the range of the specified range, e.g. 0.1 g/l to 2 g/l the satin finish obtained is relatively less glossy and when the amount of polishing agent is in the higher portion of the specified range, e.g. 4 g/l to 30 g/l the satin finish obtained is more glossy.

Further, if the polyamide copolymerized nylon resin or the polyamide modified nylon resin is used as the resin additive, the desirable degree of glossiness can be obtained with relatively less polishing agent than when the polyamide copolymer of the dimer acid and aliphatic polyamine resin is used as the additive.

The organic quaternary ammonium halide surfactants are added in amounts sufficient to stabilize the electroplating bath for the desired intended use of the bath. The amount of surface active agent added will depend to some extent on the particular polyamide resin used, the concentration of the polyamide resin, the amount of and the polishing agent used, and which of the specific surfactants are used.

The surfactants can be added in amounts of 1 ppm to 1,000 ppm. The amount of and the specific surface active agent used affects the appearance of the satin finish obtained and the grain size of the metal plated from the bath. The nickel metal plated can have a grain size of about 0.25 to 1.25 $\mu$, and preferably 0.5 to 1.0 $\mu$.

The aliphatic and/or aromatic quaternary ammonium salt surfactants such as the alkyl trimethyl quaternary ammonium chloride and di-alkylbenzyl quaternary ammonium chloride surfactants can be added in amounts of 0.5 to 1,000 ppm, preferably 1 to 500 ppm. When the amount of polyamide resin is relatively large the surfactant can be added in an amount of 200 to 500 ppm and when the amount of polyamide is relatively small the surfactant can be added in an amount of 1 ppm to 200 ppm.

The aliphatic and/or aromatic quaternary ammonium salt surfactants to some extent effect the grain size of the nickel plated surface formed. The grain size is generally 0.25 to 1.0 $\mu$ and preferably about 0.5 $\mu$ to obtain a satisfactory satin finish.

The fluorosulfonylamine quaternary ammonium salt surfactants such as those of formula VI, VII, VIII, and IX can be added to the bath in amounts of 1 ppm to 1,000 ppm and preferably 5 to 100 ppm. In less than about 1 ppm of surfactants is added to the bath the emulsion is unstable and when more than about 1,000 ppm surfactants is added to the baths the nickel plated surface is fragile.

The fluorosulfonylamine salt surfactant to some extent effects the grain size of the nickel plated surface formed. The grain size is generally about 0.5 to 1.25 $\mu$ and preferably about 0.75 $\mu$ to obtain a satisfactory satin finish. The finish obtained is generally relatively rough and glossy in appearance.

The organo quarternary ammonium salt surfactants are believed to surround and adhere to the dispersed polyamide resin particles in the emulsion and thus stabilize the bath. Because of the stabilizing effect of the surfactants in the bath of the polyamide resins can be used in concentrations at the lower end of the specified ranges, stable baths maintained and the desired satin finish still be obtained.

The above-described aliphatic and/or aromatic and the described fluorosulfonylamine quaternary ammonium salt surfactants can be used alone or in combination.

The aliphatic and/or aromatic quaternary ammonium salt surfactants are found to significantly improve the stability of the electroplating emulsion bath. The fluorosulfonylamine quaternary ammonium salt surfactants are found to substantially and greatly further improve the stability of the bath when used alone or in combination with the aforementioned surfactants.

When the two surfactants are used together, it is believed that the fluorosulfonylamine surfactant surrounds and adheres to the dispersed polyamide resin particles and that the aliphatic and/or aromatic quaternary ammonium salt surfactant acts in combination with the fluorosulfonyl surfactant also surrounding and adhering to the dispersed polyamide resin particle to further stabilize the emulsion.

Operation Conditions

The electroplating operation can be carried out at temperatures of 25° to 90° C, preferably 35° to 80° C and more preferably 40° to 65° C. When the temperature of the bath is too low, burn marks may appear on the nickel plated surface and when the temperature is too high, it becomes difficult to control the plating operation.

The current density applied during the electroplating step can be 0.1 to 20 A/dm$^2$, preferably 0.2 to 15 A/dm$^2$ and more preferably 0.5 to 12 A/dm$^2$. The period of time required to electroplate a particular material depends to a large extent on the desired thickness of the plated material and cathode current density. For example for plating metallic nickel at current density of 3 A/dm$^2$ to a thickness of 0.5 to 10 $\mu$ and preferably 2.5 to 7.5 $\mu$ the electroplating step is carried out for 1 to 20 minutes preferably 5 to 15 minutes and more preferably about 10 minutes. The period of time during which and electroplating bath remains stable and the electroplating operation can be carried out and still maintain a uniform satin-finish nickel plate surface on the material plated depends on whether or not a surfactant is used, whether the aliphatic and/or aromatic quaternary ammonium salt surfactant is used or whether the fluorosulfonylamine salt surfactant is used.

Without the addition of any surfactant the electroplating emulsion bath of the present invention can be used for 1 minute up to 2 hours, and still obtain a uniform satin-finish nickel plate surface on the material plated.

When using the aliphatic and/or aromatic quaternary ammonium salt surfactant in the prescribed amounts the electroplating operation can be carried out for 1 minutes to 6 hours, while still obtaining a uniform satin-finish nickel plate surface on the material plated.

When using the fluorosulfonylamine quaternary ammonium salt surfactants within the amounts prescribed herein the electroplating operation can be carried out for 1 minutes to 30 hours, while still obtaining a uniform satin-finish nickel plate surface on the material plated. During each of the above three nickel plating operations the various constituents of the electroplating bath can be replenished as consumed without materially interrupting the operation of the bath and in each case still obtain a uniform satin-finish nickel plate surface on the material plated.

The stability of the electroplating bath of the present invention, after initial preparation when standing not in use, depends on whether or not a surfactant is present, whether the aliphatic and/or aromatic quaternary ammonium salt surfactant is used and/or whether or not the fluorosulfonylamine quaternary ammonium salt surfactant is used. The electroplating baths without the addition of a surfactant are generally stable for at least 2 hours.

When the aliphatic and/or aromatic quaternary ammonium salt surfactants are used, the baths are generally stable for at least 3 days. And when the fluorosulfonylamine quaternary ammonium salt surfactants are used, the baths are generally stable for a week.

Obviously the stability of each of the three above-described electroplating baths will depend to some extent on the specific constituents of the baths and the amounts of the constituents added to the baths, but will generally be within the above-mentioned periods of time.

The electroplating emulsion baths of the present invention can be easily and inexpensively regenerated after use or after standing for a prolonged period of time simply by filtering the baths through a normal cartridge type filter to remove precipitated and coagulated materials. The filters normally used to carry out the regeneration step do not remove the dispersed polyamide resin emulsion particles. After the filtering step the constituents such as nickel salts, polyamide resins, polishing agents and/or surfactants can be added to bring the concentration of the respective constituents to the desired levels.

DETAILED DESCRIPTION OF DRAWINGS

The FIG. 1 of the drawings illustrates in graphic form the measured surface roughness obtained from electroplating a brass plate from the bath of Example 21, paragraphs (a) and (f) (without any surfactant) wherein the electroplating operation is carried for 10 minutes at a current density of 0.5 to 15 A/dm$^2$. The surface measurements were taken at current density values of 7 A/dm$^2$ and 2 A/dm$^2$, respectively, as shown in the drawing.

Figure 2:
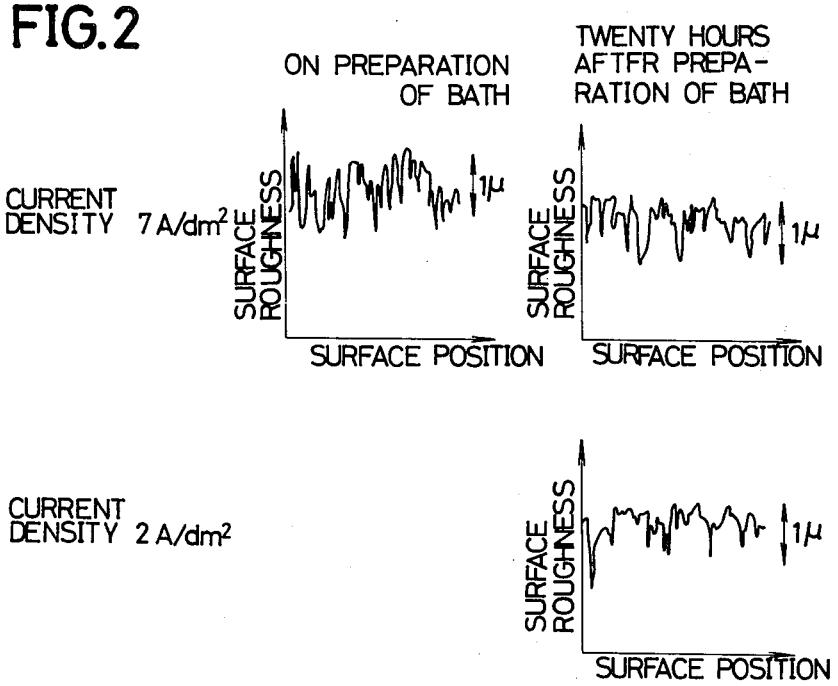
FIG. 2 is a graph illustrating the surface roughness of a nickel plated material obtained from a bath in which a fluorosulfonylamine salt surfactant was used.

The FIG. 2 of the drawings illustrates in graphic form the measured surface roughness obtained from electroplating a brass plate from the bath of Example 21, paragraph b, on initial preparation of the bath in which a fluorosulfonylamine surfactant was added and the electroplating operation was carried out for 10 minutes at a current density of 0.5 to 15 A/dm² and the surface measurement was taken at a current density value of 7 A/dm² as shown in the drawing. The FIG. 2 also illustrates the measured surface roughness obtained after 20 hours (Example 21, paragraph (e)) wherein the electroplating operation was carried out for 10 minutes at a current density of 0.5 to 10 A/dm² and the surface roughness measurements were taken at current density values of 7 A/dm² and 2 A/dm², respectively, as shown in the drawings.

The following examples are offered as illustrative of the invention.

Example 1

A watts' electroplating bath was prepared which contained the following constituents.

| | | |
|---|---|---|
| Nickel Salt | $NiSO_4 . 7H_2O$ | 280 g/l |
| | $NiCl_2 . 6H_2O$ | 50 g/l |
| Acid | $H_3BO_3$ | 40 g/l |
| Polyamide Resin | Tohmide No. 210(1) | 400 ppm |
| Polishing Agent | Na-1,5-naphthalene disulfonate | 1000 ppm |
| Surfactant | Alkyl(2)trimethy ammonium chloride | 30 ppm |
| ph of Bath | | 4.6 |
| Temperature | | 40 to 70° C |
| Surface Roughness(3) | | |

(1)Dissolved in methyl alcohol.
(2)Alkyl group consists of $C_{15}H_{31}$—.
(3)SUR FCOM 50A Roughness Tester Manufactured by Tokyo Seimitsu K.K.

a. A mirror-polished brass plate was electroplated at a current density of 0.2 to 12 A/dm² for about ten minutes to obtain a slightly lustrous uniform satin-finish nickel plate surface on the brass. The nickel plate surface was measured and had a roughness of about 0.5 μ.

b. The bath was allowed to stand for a week at a temperature of 55° C and then another mirror-polished brass plate was electroplated under the same conditions as above to obtain a uniform satin-finish nickel plate surface that was only a little different in appearance and roughness from that obtained from the initially prepared bath.

c. The bath was allowed to stand for 2 weeks at about room temperature after which it was filtered at a rate of 25 l/min for about 6 hours through a normal cartridge type filter to remove any flocculent precipitants or coagulants from the bath. The filter does not remove emulsified, i.e. dispersed polyamide resin particles. After the filtration step about 300 ppm of Tohmide 210 polyamide resin and about 25 ppm of Na-1,5-naphthalene disulfonate polishing agent were added to the bath. Another mirror-polished brass plate was electroplated under the same conditions as were used in the initially prepared bath to obtain a satin-finish nickel plate surface that was similar to the satin-finish surface obtained from the initially prepared bath.

The Watts' electroplating bath, the mirror-polished brass plate, the electroplating procedure and the method of measuring the surface roughness used in Example 1, are the same, except where indicated to be different, in the following Examples 2 to 15.

the concentration of the $H_3B0_3$ acid was slightly adjusted as necessary in each Example to give the indicated pH.

Example 2

| | | |
|---|---|---|
| Polyamide Resin | Tohmide No. 210 | 40 ppm |
| pH of Bath | | 3.8 |

-continued

| | |
|---|---|
| Temperature | 65° C |

a. The brass plate was electroplated to obtain a satin-finish nickel plate surface on the brass. The measured surface roughness was 0.5 μ.

b. The bath was allowed to stand for 25 hours at about room temperature and then another brass plate was electroplated under the same conditions as mentioned in the immediate above paragraph to obtain a satin-finish nickel plate surface that was substantially the same as that obtained from the bath as initially prepared.

EXAMPLE 3

| | | |
|---|---|---|
| Polyamide Resin | Tohmide No. 215 | 200 ppm |
| Polishing Agent | Na-Salt of Saccharin | 1000 ppm |
| pH of Bath | | 5.5 |
| Temperature | | 45° C |

The brass plate was electroplated to obtain a satin-finish nickel plate surface on the brass which satin-finish was the same as that obtained in Example 1(a).

EXAMPLE 4

| | | |
|---|---|---|
| Polyamide Resin | Tohmide No. 235S | 400 ppm |
| Polishing Agent | Na-Salt of Saccharin | 1000 ppm |
| pH of Bath | | 1.4 |
| Temperature | | 55° C |

The brass plate was electroplated to obtain a satin-finish nickel plate surface on the brass which was the same as that obtained in Example 1(a).

EXAMPLE 5

| | | |
|---|---|---|
| Polyamide Resin | Tohmide No. 210 | 3 ppm |
| Polishing Agent | Na-Salt of Saccharin | 500 ppm |
| pH of Bath | | 2.0 |
| Temperature | | 80° C |

The brass plate was electroplated to obtain a satin-finish nickel plate surface on the brass which was the same as that obtained in Example 2(a).

EXAMPLE 6

| | | |
|---|---|---|
| Polyamide Resin | Tohmide No. 210 | 5000 ppm |
| Polishing Agent | Na-Salt of Saccharin | 1000 ppm |
| pH of Bath | | 4.0 |
| Temperature | | 35° C |

The brass plate was electroplated to obtain a satin-finish nickel plate surface on the brass which was slightly deteriorated in glossiness as compared with the satin-finish surface obtained in Example 2(a).

EXAMPLE 7

| | | |
|---|---|---|
| Polyamide Resin | Versamid No. 100 | 400 ppm |
| Polishing Agent | Na-Salt of Saccharin | 1000 ppm |
| pH of Bath | | 4.4 |

-continued

| | |
|---|---|
| Temperature | 40 to 70° C |

a. A mirror-polished brass plate was electroplated at a current density of 0.5 to 10 A/dm² for about 10 minutes to obtain a uniform satin-finish nickel plate surface on the brass. The measured surface roughness was about 0.5 μ.

b. The bath was allowed to stand for about a week at a temperature of 55° C and then another mirror-polished brass plate was electroplated under the same conditions as used in the immediately above paragraph to obtain a satin-finish nickel plate surface that was only slightly different in roughness and appearance to the satin-finish surface obtained from the initially prepared bath.

c. The bath was then allowed to stand for ten days at about room temperature after which it was filtered at a rate of 25 l/min. for about six hours through a normal cartridge type filter to remove any flocculent precipitants. or coagulants from the bath. After the filtration step, about 200 ppm of Versamid No. 100 was added to the bath. Another mirror-polished brass plate was then electroplated under the same conditions as used with the initially prepared bath to obtain a satin-finish nickel plate surface that was substantially the same in roughness and appearance as the satin-finish surface obtained from the initially prepared bath.

EXAMPLE 8

| | | |
|---|---|---|
| Polyamide Resin | Versamid No. 115 | 80 ppm |
| Polishing Agent | Na-Salt of Saccharin | 10,000 ppm (10 g/l) |

a. The brass plate was electroplated under the same conditions as in Example 7(a) to obtain a uniform satin-finish nickel plate surface on the brass that was substantially the same as obtained in Example 7(a).

b. The bath was allowed to stand for about 15 hours at about room temperature and then another brass plate was electroplated under the same conditions as mentioned in the immediate above paragraph to obtain a satin-finish nickel plate surface that was similar to that obtained with the bath as initially prepared but had a more intensive luster.

c. The bath as initially prepared was allowed to stand for about 20 hours at about room temperature and then another brass plate was electroplated under the same conditions as the bath as initially prepared to obtain a satin-finish that was similar to that obtained with the bath as initially prepared but had a more lustrous appearance.

Since the added amount of the polishing agent was increased and the added amount of the polyamide resin was reduced in comparison to the respective amounts used in Example 7, the luster of the satin-finishes obtained were more intensive and more lustrous after allowing the bath to stand for the 15 and 20 hours, respectively.

EXAMPLE 9

| | | |
|---|---|---|
| Polyamide Resin | Versamid No. 115 | 20 ppm |
| Polishing Agent | Na-Salt of Saccharin | 10,000 ppm |
| pH of Bath | | 4.5 |

-continued

| | |
|---|---|
| Temperature | 50° C |

a. The brass plate was electroplated under the same conditions as in Example 7(a) to obtain a satin-finish nickel plate surface on the brass in which the luster or glossiness was more intensive than that obtained in Example 8(a).

The more intensive luster or glossiness that was obtained was due to decreasing the amount of polyamide resin (relative to Example 8(a)) while leaving the amount of polishing agent unchanged.

b. COMPARISON

A comparison example was carried out as follows.

| | | |
|---|---|---|
| Polyamide Resin | Versamid No. 115 | 0.5 ppm |
| Polishing Agent | Na-Salt of Saccharin | 500 ppm |
| pH of Bath | | 4.4–4.5 |

The brass plate was electroplated under the same conditions as in Example 7(a) to obtain a lesser satin-surface finish effect that was obtained in the immediately preceding Example. The satin-finish effect obtained was undesirable and was due to using an amount of polyamide resin below the specified range.

EXAMPLES 10 to 12

| | | |
|---|---|---|
| 10. Polyamide Resin | Versamid No. 115 | 300 ppm |
| 11. Polyamide Resin | Versamid No. 125 | 200 ppm |
| 12. Polyamide Resin | Versamid No. 140 | 400 ppm |

The brass plates in each of Examples 10 to 12 were electroplated under the same conditions as in Example 7 to obtain in each case very good uniform satin-finish nickel plate surfaces on the respective brass plates.

EXAMPLES 13

| | | |
|---|---|---|
| Polyamide Resin | Type 8 Nylon | 800 ppm |
| Polishing Agent | Na-Salt of Saccharin | 500 ppm |
| pH of Bath | | 6.0 |
| Temperature | | 35 to 75° C |

a. The brass plate was electroplated at a current density of 0.5 to 10 A/dm² for about 10 minutes to obtain a uniform pit-less satin-finish nickel plate surface on the brass. The measured surface roughness was about 0.5 μ.

b. COMPARISON

A comparison example was carried out as follows.

| | | |
|---|---|---|
| Polyamide Resin | Type 8 Nylon | 15,000 ppm |

The brass plate was electroplated under the conditions of the immediately preceding paragraph to obtain a non-uniform plated surface that was resinous and on which the flocculated polyamide resin adhered. The undesirable results were obtained because of the use of an excessive amount of the polyamide resin which amount was outside of the range herein specified. The use of the large amount of polyamide resin was found to substantially increase the flocculating rate of the emulsion bath.

c. COMPARISON

A second comparison example was carried out as follows.

| | | |
|---|---|---|
| Polyamide Resin | Type 8 Nylon | 0.5 ppm |

The brass plate was electroplated under the conditions of paragraph 13(a) to obtain a reduced satin-finish effect nickel plated surface on the brass. The satin-finish effect obtained was not desirable. The adverse effects obtained in the electroplating step were due to using an amount of polyamide resin in the bath below the range herein specified.

EXAMPLE 14

| | | |
|---|---|---|
| Polyamide Resin | Nylon No. 5053 | 400 ppm |
| Polishing Agent | Na-Salt Saccharin | 250 ppm |
| pH of Bath | | 6.0 |
| Temperature | | 35–75° C |

The brass plate was electroplated at a current density of 0.5 to 10 A/dm² for about 10 minutes to obtain a uniform satin-finish nickel plate surface on the brass. The measured surface roughness was about 1 μ.

EXAMPLE 15

| | | |
|---|---|---|
| Polyamide Resin | Saitel 63 | 2,000 ppm |
| Polishing Agent | Na-Salt Saccharin | 500 ppm |
| pH of Bath | | 4.0 |
| Temperature | | 40 to 70° C |

The brass plate was electroplated at a current density of 1 to 10 A/dm² for 10 minutes to obtain a uniform pit-less semi-lustrous satin-finish nickel plate surface on the brass. The measured surface roughness was about 0.5 μ.

EXAMPLE 16

An aqueous sulfamate electroplating bath was prepared in which water was used as a solvent. The bath composition and the electroplating operation are described below.

| | | |
|---|---|---|
| Nickel Salt | Ni Sulfamate | 410 g/l |
| | $NiCl \cdot 6H_2O$ | 30 g/l |
| Acid | $H_3BO_3$ | 40 g/l |
| Polyamide Resin | Versamid No. 110 | 400 ppm |
| Polishing Agent | Na-Salt Saccharin | 500 ppm |
| Surfactant | (None) | |
| pH of Bath | | 4.8 |
| Temperature | | 50° C |

A mirror-polished brass plate was electroplated at a current density of 0.5 to 15 A/dm² for about 10 minutes to obtain a uniform satin-finish nickel plate surface on the brass. The measured surface roughness was about 0.5 μ.

EXAMPLES 17 and 18

These Examples differed from Example 16 only as follows.

| | | | |
|---|---|---|---|
| 17. | Polyamide Resin | Type 8 Nylon | 400 ppm |
| | pH of Bath | | 6.0 |
| | Temperature | | 45° C |
| 18. | Polyamide Resin | Nylon 5053 | 800 ppm |
| | pH of Bath | | 6.0 |
| | Temperature | | 45° C |

The brass plate in each of Examples 17 and 18 were electroplated under the same conditions of Example 16 to obtain in each case uniform satin-finish nickel plate surfaces on the respective brass plates.

EXAMPLE 19

A Watts' electroplating bath was prepared in accordance with Example 1 and modified as follows.

| | | |
|---|---|---|
| Polyamide Resin | Tohmide No. 210 | 50 ppm |
| Polishing Agent | Saccharine Soda | 8 g/l |
| Surfactant | (None) | — |
| pH | | 4.2 to 4.8 |
| Temperature | | 55° C |

a. A brass plate was electroplated at a current density of 0.7 to 15 A/dm² for about 10 minutes to obtain a uniform satin-finish nickel plate surface on the brass. The measured roughness was about 0.6 μ.

b. Two hours after the preparation of the bath, a brass plate was electroplated for 10 minutes and the range of current density used to obtain a uniform satinfinish nickel plate surface on the brass changed to 3 to 15 A/dm². The measured roughness was about 1 μ.

c. To the bath as initially prepared was added:

Surfactant Fluorosulfonylamine Formula VII 20 ppm

A brass plate was electroplated at a current density of 0.5 to 15 A/dm² for about 10 minutes to obtain a uniform satin-finish nickel plate surface on the brass. The measured roughness was about 0.6 μ, d. Six hours after the preparation of the bath described in the paragraph immediately above, a brass plate was electroplated for 10 minutes and the range of current density used to obtain a uniform satin-finish nickel plate surface on the brass did not change. The measured roughness was about 1 μ.

EXAMPLE 20

| | | |
|---|---|---|
| Polyamide Resin | Vesamid No. 110 | 5 ppm |
| Polishing Agent | Na-Salt Saccharin | 10,000 ppm (10 g/l) |
| Surfactant | Alkyltrimethyl quaternary ammonium salt[1] | 20 ppm |
| pH of Bath | | 5.2 |
| Temperature | | 65° C |

[1]The alkyl group is $C_{17}H_{35}$—.

a. a brass plate was electroplated under the conditions of Example 19 at a current density of 1 to 12 A/dm² for 10 minutes to obtian a uniform satin-finish nickel plate surface on the brass. The measured surface roughness about 0.6 μ.

b. Two hours after the preparation of the bath a brass plate was electroplated for 10 minutes and the range of current density used to obtain a uniform satin-finish on the brass changed to 3 to 12 A/dm².

c. To the bath as initially prepared there was added:

Surfactant Fluorosulfonylamine Formula VIII 800 ppm in place of the alkyltrimethyl quaternary ammonium salt surfactant.

A brass plate was electroplated at a current density of 0.5 to 12 A/dm² for 10 minuted to obtain a uniform satin-finish nickel plate surface on the brass. The measured surface roughness was about 0.6 μ.

d. Seventy-two hours after preparation of the bath of paragraph (c), a brass plate was electroplated for 10 minutes and the range of current density used to obtain a uniform satin-finish nickel plate surface did not change. The measured roughness was about 1 μ.

EXAMPLE 21

| | | |
|---|---|---|
| Polyamide Resin | Nylon No. 5053 | 200 ppm |
| Polishing Agent | Na-Salt Saccharin | 1,000 ppm (1 g/l) |
| Surfactant | Alkyltrimethyl quarternary ammonium salt[1] | 40 ppm |
| pH of Bath | | 4.0 |
| Temperature | | 45° C |

[1]The alkyl group is $C_{15}H_{31}$—.

a. A brass plate was electroplated under the conditions of Example 19 at a current density of 1.5 to 10 A/dm² for 10 minutes to obtain a uniform satin-finish nickel plate surface on the brass. The measured roughness was about 0.8 μ.

b. Two hours after the preparation of the bath, a brass plate was electroplated for 10 minutes, the range of current density used to obtain a uniform satin-finish on the brass plate changed to 3 to 10 A/dm² and the luster of the satin-finish was intensified. The measured surface roughness was about 1 μ.

c. To the bath as initially prepared the

Surfactant Fluorosulfonylamine Formula IX 100 ppm was substituted for the alkyltrimethyl quaternary ammonium salt surfactant. A brass plate was electroplated at a current density of 0.7 to 10 A/dm² for 10 minutes to obtain a uniform satin-finish nickel plate surface on the brass. The measured surface roughness was about 0.8 μ.

d. Two hours after the preparation of the bath of the immediately preceding paragraph a brass plate was electroplated for 10 minutes and the range of current density used to obtain a uniform satin-finish nickel plate surface did not change. The measured surface roughness was about 0.7 μ.

e. Twenty hours after the preparation of the bath of paragraph (c), a brass plate was electroplated for 10 minutes at a current density of 0.5 to 15 A/dm² to obtain a uniform satin-finish nickel plate surface on the brass that was scarcely changed from the satin-finish surface obtained from the bath of paragraph (c) (see FIG. 2 of drawing).

The measured surface roughness was large, i.e. about 1 μ. In another words a good satin-finish nickel plate surface was obtained.

f. A brass plate was electroplated in the bath of paragraph (a), with the exception that no surfactant was used, at a current density of 0.8 to 15 A/dm² for 10 minutes to obtain a uniform satin-finish nickel plate surface on the brass. The measured surface roughness was 1 to 1.3 μ.

g. Two hours after the initial preparation of the bath in the immediately preceding paragraph, a brass plate was electroplated at a current density of 0.8 to 15 A/dm² for 10 minutes to obtain a glossy plated surface in which the roughness was substantially reduced and the satin-finish effect was scarcely obtained (see FIG. 1 of drawing).

The use of the fluorosulfonylamine salt surfactant was found to reduce the number of pits formed in the satin-finish as compared with the number of pits formed when the surfactant was not used.

The stability of the electroplating emulsion bath when the fluorosulfonylamine salt surfactant was added was found to be over five times as high as the stability of the bath when the fluorosulfonylamine salt surfactant was not used. This substantial increase in stability of the electroplating emulsion bath reduces the amount of bath regeneration apparatus capacity required to about less than one-fifth of what would be required when the fluorosulfonylamine salt surfactant was not used.

The surface roughness of the plated brass in Examples 16 to 21 where reported was measured in the same manner as in Example 1.

While there have been described preferred embodiments in various illustrative examples of the invention, obvious modifications are possible in the light of the above disclosure. It is, therefore, to be understood that the invention may be practiced other than as specifically described herein.

What is claimed is:

1. An acidic nickel electroplating bath composition for obtaining a uniform satin-finish metal plate surface on the material plated which comprises

| | | | | |
|---|---|---|---|---|
| (1) | nickel | 25 | to | 170 gm/l |
| (2) | polyamide resin dissolved in a low molecular weight alcohol having 1 to 3 carbon atoms | 1 | to | 10,000 ppm |
| (3) | polishing agent | 0.1 | to | 40 gm/l |

wherein nickel is dissolved and forms a continuous aqueous phase solution and the polyamide resin is dispersed in the aqueous phase to form a stable emulsion.

2. The composition of claim 1 wherein the polyamide resin has an amide linkage in the molecule and is a member selected from the group consisting of a. a copolymer of a dimer of an unsaturated fatty acid and an aliphatic amine, b. a copolymerized nylon, and c. a modified nylon.

3. The composition of claim 1 containing 0.5 to 1,000 ppm of a cationic organic quaternary ammonium salt surfactant.

4. The composition of claim 3 wherein the surfactant is a member selected from the group of aliphatic quaternary ammonium salts and aliphatic, aromatic quaternary ammonium salts.

5. A process for electroplating a metal surface which comprises using an aqueous acidic electroplating bath composition comprising

| | | | | |
|---|---|---|---|---|
| (1) | nickel | 25 | to | 170 gm/l |
| (2) | polyamide resin dissolved in a low molecular weight alcohol having 1 to 3 carbon atoms | 1 | to | 10,000 ppm |
| (3) | polishing agent | 0.1 | to | 40 gm/l |

wherein the metal is dissolved and forms a continuous aqueous phase solution and the polyamide resin is dispersed in the aqueous phase to form a stable emulsion, adjusting the pH of the solution to a value of 1.4 to 6.0, electroplating said metal on said surface at a temperature of 35° to 80° C and a current density of 0.1 to 20 A/dm².

6. The process of claim 6 wherein the polyamide resin is a member selected from the group consisting of a. a copolymer of a dimer of an unsaturated fatty acid and an aliphatic amine, b. a copolymerized nylon, and c. a modified nylon.

7. An acidic nickel electroplating emulsion bath composition for obtaining a uniform satin-finish nickel plate surface on the material plated which comprises 1. a sufficient amount of a water soluble nickel salt to obtain in said bath nickel in the amount of 30 to 150 gm/1

2. a polyamide resin dissolved in a low molecular weight alcohol having 1 to 3 carbon atoms and being present in the amount of 1 to 10,000 ppm wherein said resin is a member selected from the group consisting of a. a copolymer of a dimer acid of an unsaturated fatty acid and an aliphatic amine having the formula $$H_2N\text{-}[(CH_2-CH_2-NH)_{n_1}-OC-R-CONH(CH_2-CH_2-NH)_{n_2}]_{n'}-H \quad \text{I}$$

wherein R represents the residual radical of the dimer unsaturated acid containing 14 to 46 carbon atoms, one of $n_1$ and $n_2$ = 0 to 5 and the other of $n_1$ and $n_2$ = 1 to 5, and $n'$ = 1 to 13, b. a copolymerized nylon of a copolymer of at least two homo-nylons defined by a number $n$ from 5 to 11 in the following formula;

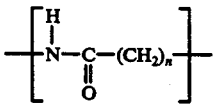

IVa and defined by a number $n_1$, from 2 to 12 and $n_2$ from 4 to 12 in the following formula;

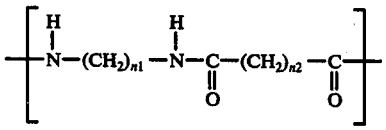

IVb c. a modified nylon containing the following unit in the molecule;

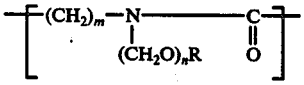

V wherein R represents methyl or ethyl, n=1 to 5 and m=5 to 11.

3. a polishing agent in an amount of 0.1-30g/1 of said bath selected from the group consisting of alkali metal salts of aromatic sulfonic acid, aromatic sulfonamide, aromatic sulfonimide, alkali metal salts of aromatic sulfonamide, and alkali metal salts of aromatic sulfonimide.

8. The composition of claim 7 wherein the nickel salt is a member selected from the group consisting of nickel sulfate, nickel chloride, and nickel sulfamate.

9. The composition of claim 7 wherein the alcohol is a member selected from the group consisting of methyl, ethyl and normal and isopropyl alcohol.

10. The composition of claim 7 containing 0.5 to 1,000 ppm of a cationic organic quaternary ammonium salt surfactant.

11. The composition of claim 10 containing 1 to 500 ppm of a surfactant which is a member selected from the group consisting of aliphatic quaternary ammonium halides and aliphatic aromatic quaternary ammonium halides wherein the alkyl group contains 11 to 21 carbon atoms and the aromatic group contains 6 to 12 carbon atoms.

12. The composition of claim 10 wherein the polishing agent is a member selected from the group consisting of sodium, naphthalene, mono-,di-,or trisulfonate, sodium salts of saccharin and sodium paratoluene-sulfonamide.

13. The composition of claim 7 wherein the copolymer of a dimer acid and an aliphatic polyamine is added in an amount of 1 to 1,000 ppm and the molecular weight of said copolymer is in the range of 600 to 7,000.

14. The compositon of claim 7 wherein the copolymerized nylon is added in an amount of 1 to 10,000 ppm and the molecular weight of said copolymerized nylon is in the range of about 5,000 to 100,000.

15. The composition of claim 7 wherein the modified nylon is added in an amount of 1 to 10,000 ppm and the molecular weight of the modified nylon is in the range of 5,000 to 100,000.

16. The composition of claim 7 wherein the copolymer of a dimer acid and an aliphatic polyamine is added in an amount of 3 to 200 ppm and the molecular weight of said copolymer is in the range of 600 to 7,000.

17. The composition of claim 7 wherein the copolymerized nylon is added in n amount of 500 to 3,000 ppm and the molecular weight of said copolymerized nylon is in the range of about 8,000 to 50,000.

18. The composition of claim 7 wherein the modified nylon is added in an amount of 500 to 3,000 ppm and the molecular weight of the modified nylon is in the range of 10,000 to 50,000.

19. A process for electroplating a metal surface which comprises using the electroplating bath of claim 8 wherein the nickel salt is dissolved in and forms a continuous aqueous phase solution and the polyamide resin is dispersed in the aqueous phase to form a stable emulsion, adjust the pH of the solution to a value of 1.4 to 6.0, electroplating said nickel on said surface at a temperature of 35° to 80° C and a current denisty of 0.1 to 20 A/dm².

* * * * *